US005765911A

United States Patent [19]

Sorenson

[11] Patent Number: 5,765,911

[45] Date of Patent: Jun. 16, 1998

[54] ADJUSTABLE POSITIONED SYSTEM FOR CHAIR-MOUNTED TABLES

[76] Inventor: Thomas Sorenson, 205 Vista Blvd., Suite 101, Sparks, Nev. 89434

[21] Appl. No.: 813,858

[22] Filed: Mar. 7, 1997

Related U.S. Application Data

[60] Provisional application No. 60/013,272 Mar. 12, 1996.

[51] Int. Cl.[6] ..... A47B 39/00; A47B 83/02

[52] U.S. Cl. ..... 297/173; 297/174; 297/161; 297/162; 297/170; 248/284.1

[58] Field of Search ..... 297/154, 155, 297/161, 162, 170, 174, 173; 108/49, 1, 9; 248/276.1, 282.1, 283.1, 284.1

[56] References Cited

U.S. PATENT DOCUMENTS

| | | | |
|---|---|---|---|
| 2,612,422 | 9/1952 | Sarkus | 108/49 |
| 2,954,073 | 9/1960 | Junkunc | 297/162 |
| 3,099,479 | 7/1963 | Banke | 297/162 |
| 3,543,312 | 12/1970 | Pofferi | 108/49 |
| 3,575,466 | 4/1971 | Thomas et al. . | |
| 3,586,367 | 6/1971 | Cincotta . | |
| 3,586,368 | 6/1971 | Guild . | |
| 3,717,375 | 2/1973 | Slobodan | 297/154 |
| 4,657,303 | 4/1987 | Croft . | |
| 5,106,160 | 4/1992 | Normura et al. . | |
| 5,161,766 | 11/1992 | Arima | 297/174 |
| 5,275,465 | 1/1994 | Gulliver et al. . | |
| 5,301,999 | 4/1994 | Thompson et al. | 248/284.1 |
| 5,582,464 | 12/1996 | Maymon | 297/173 |
| 5,615,620 | 4/1997 | Owen | 108/49 |

*Primary Examiner*—Milton Nelson, Jr.
*Assistant Examiner*—Anthony D. Barfield
*Attorney, Agent, or Firm*—Ian F. Burns

[57] ABSTRACT

A positioning system is provided for positioning a chair-mounted table. The positioning system utilizes four major interconnected components which are capable of rotating around four different axes to position the table in a large variety of positions and orientations. The first axis is parallel to the ground, the second axis is substantially perpendicular to the first axis, the third axis is perpendicular to the second axis, and the fourth axis is substantially 45 degrees from the third axis. The table attached to the positioning system may be moved forward and backward relative to the user, it may be rotated to various angular positions, it may be swung forward to allow the user to sit down and get up, it may be placed on the side of the chair to make a side table, and it may be swung down to the side of the chair to occupy little space and allow the chair to be used with a stand-alone desk or table.

13 Claims, 5 Drawing Sheets

FIG. 7
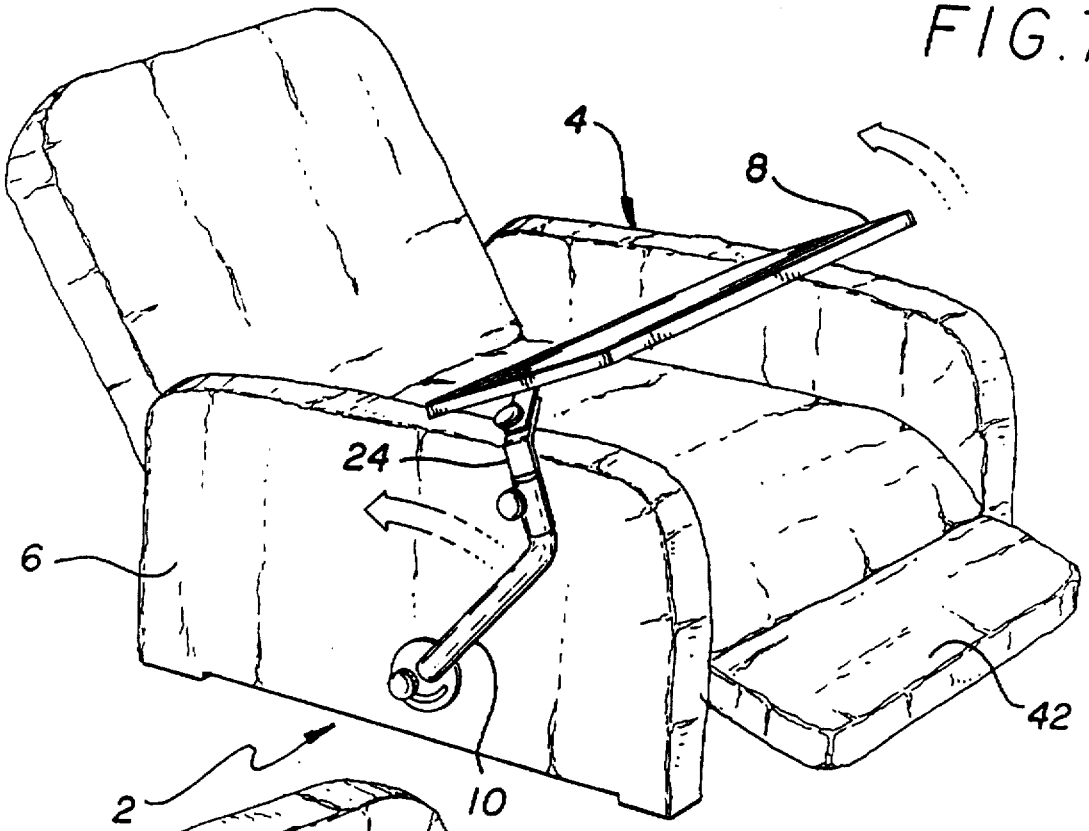
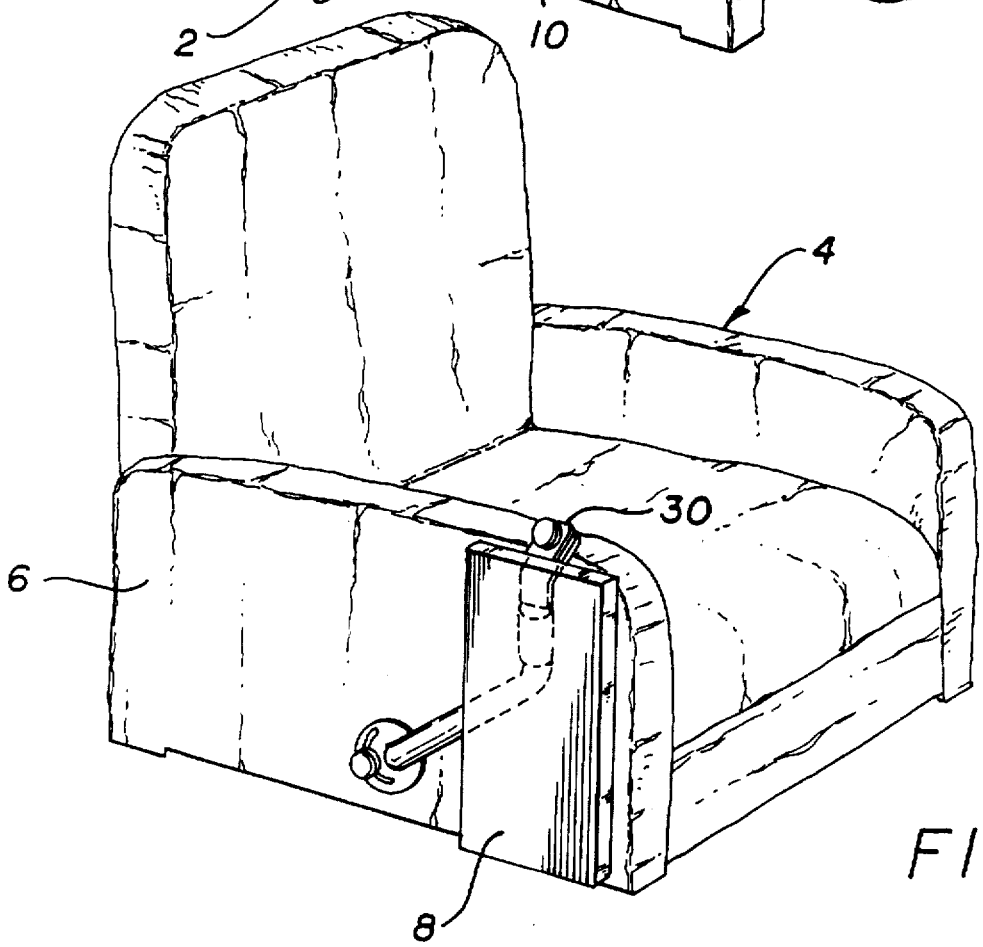
FIG. 8

ADJUSTABLE POSITIONED SYSTEM FOR CHAIR-MOUNTED TABLES

CROSS-REFERENCE TO RELATED APPLICATIONS

This application claims priority on provisional patent application 60/013,272 which was filed on Mar. 12, 1996.

BACKGROUND OF THE INVENTION

1. Field of Invention

This invention relates to a system for mounting a table to a chair which allows the table to be positioned in a large variety of positions.

2. Description of the Related Art

Chair-mounted tables are well known in the art and means for mounting tables to chairs are also well known. However, few mounting devices have been developed which allow a mounted table to be positioned in numerous orientations. Most mounting devices only allow the table to be place in one or two orientations. For example, U.S. Pat. No. 3,575,466 issued to Morton et al., discloses a chair-mounted table which has only two positions. The table may be positioned in front of the user or stored on the side of the chair.

However, chair-mounted tables are now used for a large variety of applications. In recent years, chair-mounted tables have increasingly been used to hold computer keyboards and objects related to computers, such as pointing devices. Many computer users find it more convenient and comfortable to type on a keyboard while sitting in a comfortable chair and not at a fixed desk. Some computer users also like the ability to recline in their chair and have their legs supported by a foot rest while they are typing. This position is not only relaxing but it places less stress on the user's body. There are also other uses in which versatile table positioning systems are needed. These uses include chairs for convalescing patients, chairs used for reading and leisure activities, and chairs used in classrooms.

U.S. Pat. No. 5,275,465 issued to Gulliver et al. discloses an example of a more flexible mounting system. However, this reference fails to provide a sufficient flexible mounting system. Although this mounting system allows a table 15 to be rotated away from the front of the user, as seen in FIG. 2, it is incapable of being folded into a stored position along the side of the chair to occupy minimum space. Furthermore, the mounting system does not allow the table to be placed along the side of the chair to create a convenient side table.

SUMMARY OF THE INVENTION

1. The Object of the Invention:

It is an object of the present invention to provide an improved positioning system for chair-mounted tables.

It is a further object of the present invention to provide a positioning system with a high degree of flexibility and versatility.

It is a further object of the present invention to provide a positioning system wherein the table may be placed in several stowed positions.

It is a further object of the present invention to provide a positioning system capable of storing a table in a position that takes very little room and does not interfere with the chair being used at a desk.

It is a further object of the present invention to provide a positioning system which may place the table in a side table position wherein the table may hold objects near the side of the chair.

It is a further object of the present invention to provide a positioning system which may be used with a reclining chair wherein the table may be positioned such that the user may comfortably use the table in a fully reclined position.

These and other objects and advantages of the present invention may be realized by reference to the remaining portion of the specification and drawings.

2. Brief Description of the Invention:

The positioning system of the present invention comprises a support arm which is rotatably secured to the frame of a chair. The support arm may rotate around an axis which is substantially parallel to the ground and substantially perpendicular to the side of the chair. This axis is defined as axis A. The support arm may be fixed in a particular angular position by a locking means, which, in the preferred embodiment, is a friction device which clamps a disk attached to the support arm. The support arm bends upwards 90 degrees and a second, smaller bend may also be provided on the support arm. The upper portion of the support arm defines an axis which is substantially parallel to the side of the chair. This axis is defined as axis B. A sleeve is rotatably secured to the upper portion of the support arm. The sleeve may rotate around axis B and the sleeve may also translate up and down axis B. The sleeve may be locked in position with a sleeve-locking device which may utilize friction or a locking pin and holes.

At the upper end of the sleeve, an angle support is provided which is rotatably mounted to the sleeve. The angle support rotates around an axis which is defined as axis C and which is substantially perpendicular to axis B. The angle support has a bend which is approximately 45 degrees and an angle bracket is rotatably secured to the angle support. The angle bracket may rotate around an axis that is defined as axis D and this axis is approximately 45 degrees from axis C.

A table is secured to the angle bracket and the table provides a surface upon which a user can work or place objects, such as a computer keyboard. The user can easily adjust the position of the table by adjusting the various parts of the positioning system. For example, if the user wished to move the table closer, the user would rotate the support arm rearward around axis A. To then level the table, the user would rotate the angle support forward around axis C. If the user wanted to get out of the chair without dislodging objects on the table, the user could rotate the sleeve clockwise around axis B. In this way, the angular position of the table changes very little and loose objects will not fall off the table. The sleeve may be equipped with a locking pin which would allow the table to be locked in an open position.

If the user wanted to place the table in its stowed position, the user would rotate the table and angle bracket around axis D so that the table is placed along the side of the chair. The user can also create a side table by rotating the sleeve counter clockwise so that the table is perpendicular to the side of the chair and rotating the support arm rearward so that the table becomes substantially parallel with the ground.

These and many other table positions are possible with the present invention. Unlike prior art devices, the user may easily select a position that best suits his particular application and preference. It is recognized that one or more of the components or axis of rotation described above may be eliminated from the positioning system and yet many advantages will still be achieved.

The above description sets forth, rather broadly, the more important features of the present invention or that the detail description thereof that follows may be better understood in order that present contributions to the art may be better appreciated. There are, of course, additional features of the invention that will be described hereinafter and which will form the subject matter of claims appended hereto. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 7 is a perspective view of the invention showing another possible motion of the invention with a reclining chair when the chair is in a reclined position.

FIG. 8 is a perspective view of the present invention in one of its positions.

REFERENCE NUMBERS

Figure 1:
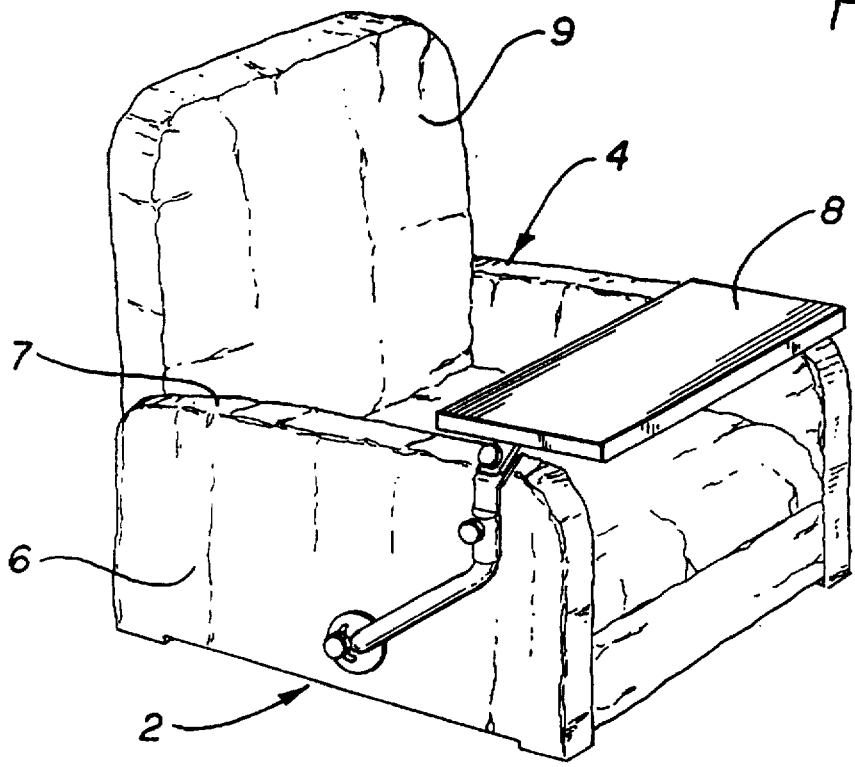
FIG. 1 is a perspective view of the positioning system of the present invention in use with a chair.

2 positioning system
4 chair
6 side panel
7 arm rest
8 table
9 backrest
10 support arm
12 frame member
14 disk
16 groove
18 friction knob
20 sleeve
22 sleeve lock
24 angle support
26 gap
28 support brake
30 angle bracket
32 bracket brake
34 groove
36 torque
38 friction knob
40 pivot plate
42 leg rest
A axis A
B axis B
C axis C
D axis D

DESCRIPTION OF THE PREFERRED EMBODIMENT

As seen in FIG. 1, a positioning system 2 of the present invention is attached to a chair 4 with a side panel 6. Side panel 6 may form an arm rest 7 for supporting a user's arm. A table 8 is attached to the upper end of positioning system 2. A backrest 9 is provided for supporting the user's back. Table 8 may hold a large variety of objects, such as a computer keyboard, a telephone, food, or a book stand, and table 8 may be used as a working surface. Positioning system 2 may be fashioned from any suitable material, such as plastic, aluminum, or steel. In the preferred embodiment, most of the components of positioning system 2 are made of steel and table 8 is made of wood or plastic. It is understood that the following description of the parts, angles and axes can be modified and adjusted to achieve substantially the same result.

Figure 2:
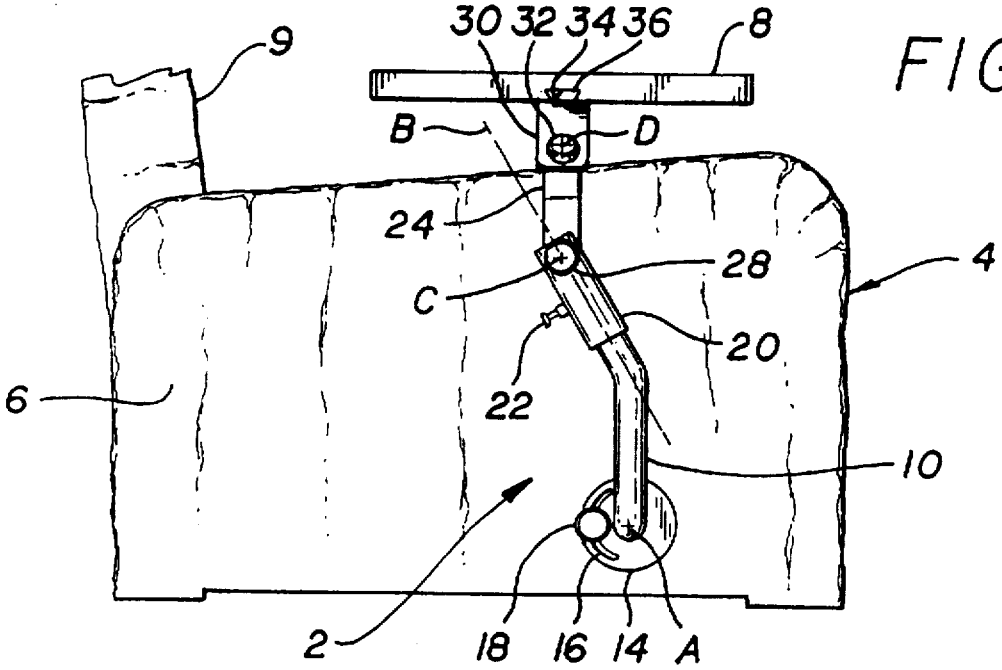
FIG. 2 is a side view of the present invention.
Figure 3:
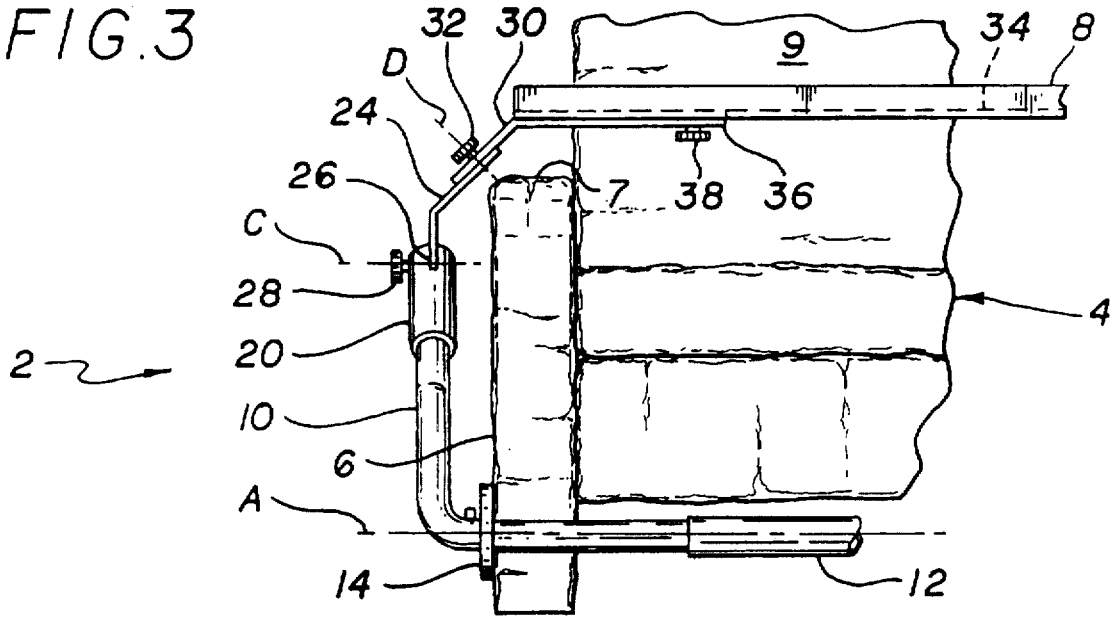
FIG. 3 is a front view of the present invention.

As seen in FIGS. 2 and 3, positioning system 2 comprises a support arm 10 which is pivotally secured to a frame member 12 of chair 4. Frame members 12 may be an integral part of the structural frame of chair 4 or it may be a member which is attached to the frame of chair 4 for the purpose of supporting position system 2. In an alternative embodiment, support arm 10 may be supported by a separate ground-based stand beneath or to the side of chair 4. In either embodiment, support arm 10 pivots around axis A which is substantially parallel to backrest 9 and substantially perpendicular to side panel 6. Support arm 10 comprises a bend which is approximately 90 degrees such that on the upper portion of support arm 10 extends upwards. This bend is in a plane which is substantially perpendicular to side panel 6. As seen in FIG. 2, a second bend may be provided which is approximately 45 degrees and in a plane which is substantially parallel to side panel 6. The upper portion of support arm 10 defines axis B which is substantially parallel to side panel 6 and perpendicular to axis A.

Support arm 10 also comprises a disk 14 which is used to secure support arm 10 in a desired angular position. A friction knob 18 extends through a groove 16 and applies a frictional force for fixing the angular position. Groove 16 is a specific length so as to limit the motion of positioning system 2. Other kinds of mechanisms may also be used for securing the position of support arm 10.

A sleeve 20 is provided at the upper end of support arm 10. Sleeve 20 may rotate around axis B for adjusting the angular position of table 8 and it may translate along axis B for adjusting the height of table 8. A sleeve lock 22 is provided on sleeve 20 for locking the position of sleeve 20. Sleeve lock 22 may comprise a pin and spring assembly with corresponding holes in support arm 10 or sleeve lock 22 may comprise a knob and friction pin.

An angle support 24 is rotatably secured to sleeve 20 such that angle support 24 may rotate around axis C. Axis C is substantially perpendicular to axis B. A gap 26 is provided in the upper end of sleeve 20 for allowing angle support 24 to freely pivot. A support brake 28, which may comprise a knob and bolt, is provided for holding angle support 24 in any selected angular position. Support brake 28 may operate by applying friction through a pinching force. Angle support 24 comprises a bend which is approximately 135 degrees.

An angle bracket 30 is provided which is rotatably secured to angle support 24. Angle bracket 30 may rotate around axis D which forms an approximately 45 degree angle with axis C. Angle bracket 30 is fixed in an angular position with bracket brake 32 which may comprise an adjusting knob and bolt and operate by applying friction through a pinching force. Angle support 24 and angle bracket 30 may have means for limiting the motion of angle bracket 30. Such means may comprise pins or tabs which abut each other at predetermined angular positions. Angle bracket 30 comprises a bend which is approximately 135 degrees. When angle bracket 30 is in its normal operating position (not stored), the upper portion defines a plane that is substantially parallel with axis C. The upper portion of angle bracket 30 is secured to and supports table 8.

Angle bracket 30 supports table 8 and may be rigidly secured with screws or other means which are well known in the art. Alternatively, means may be provided for slidably securing table 8 to angle bracket 30. This would allow table 8 to slide longitudinally across angle bracket 30 to be placed in various positions. Such attachment means may comprise a groove 34 in table 8 for receiving tongue 36 attached to angle bracket 30. Friction knob 38 may be provided for applying friction and locking table 8 in a particular position.

As will become apparent in the following description, the various elements and axes of movement of the present invention allow a level of flexibility and versatility that has never before been achieved in table positioning systems. A table attached to positioning system of the present invention may be placed in numerous positions and orientations and the entire assembly may be placed in a stowed position that requires very little room and does not interfere with typical uses of a chair. The user is afforded an unprecedented degree of flexibility and ease of use. It is also recognized that parts of the present invention may be used separately to achieve a desired degree of freedom of motion.

Figure 4:
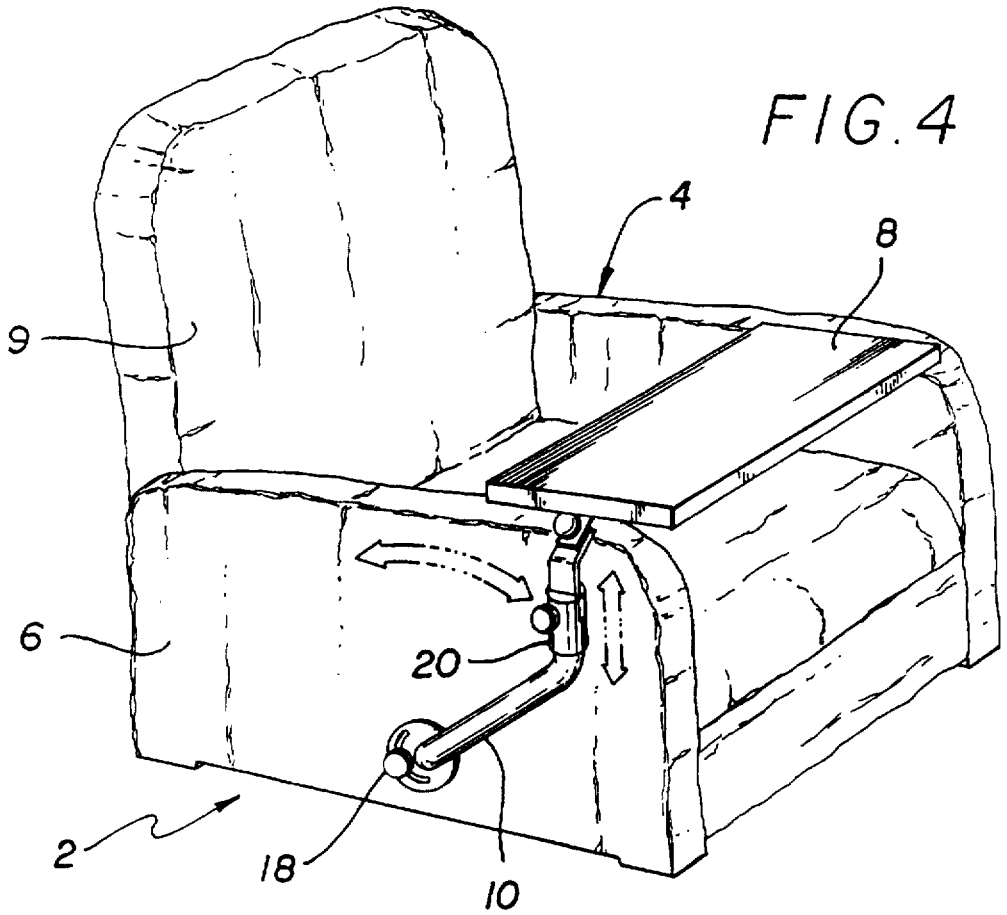
FIG. 4 is a perspective view of the invention showing one possible motion of the invention.

As seen in FIG. 4, the angular position of support arm 10 along axis A controls how close table 8 is to the user as he sits in chair 4. The user may loosen friction knob 18 and move table 8 closer or further away from backrest 9 of chair 8. This allows the user to select the most comfortable horizontal position. The user may also raise or lower table 8 relative to axis A by adjusting the position of sleeve 20 (along axis B) relative to support arm 10.

Figure 5:
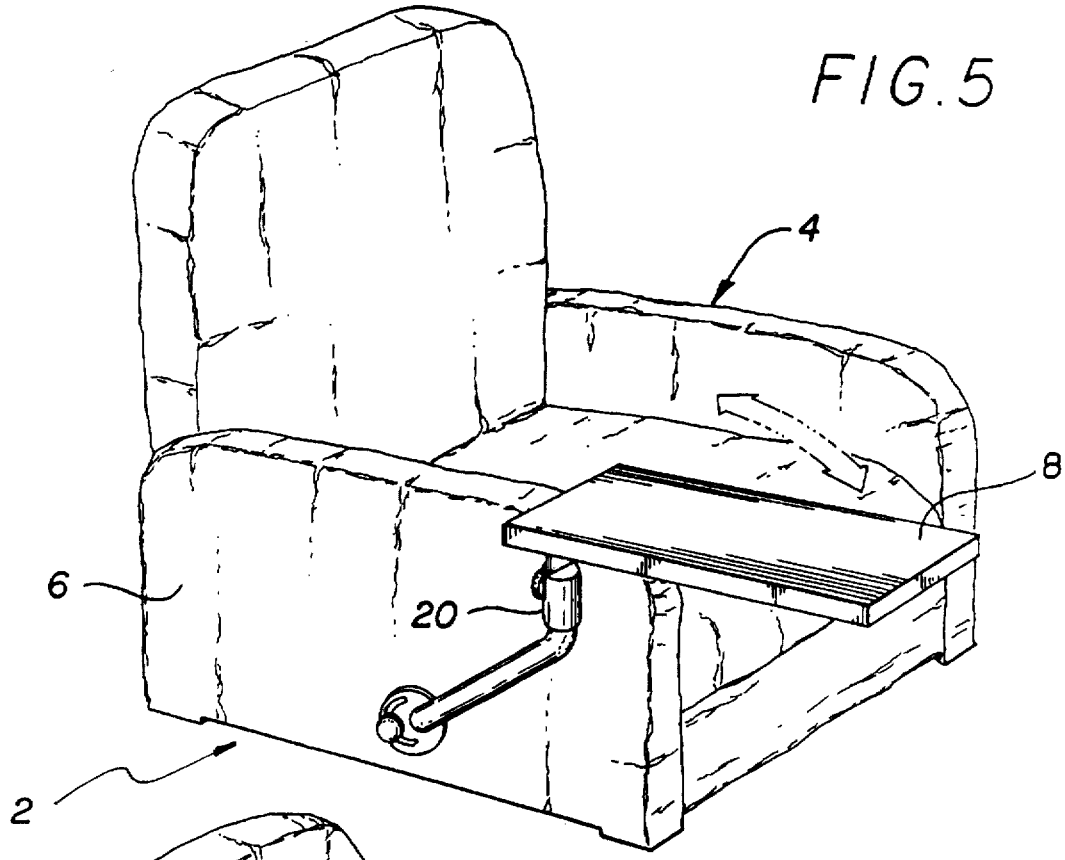
FIG. 5 is a perspective view of the invention showing another possible motion of the invention.

As seen in FIG. 5, sleeve 20 may also be used to rotate table 8 around axis B. The user may rotate table 8 away from the back of chair 4 so that the user can get into and out of the chair. Table 8 may be placed in a position that is 270 degrees from its normal operating position. In this position table 8 is placed close to the side of chair 4 and becomes a high-side table that may be used to hold objects, such as a telephone. Sleeve 20 may also be used to adjust the vertical height of table 8 allowing the user to select the most comfortable vertical position.

Figure 6:
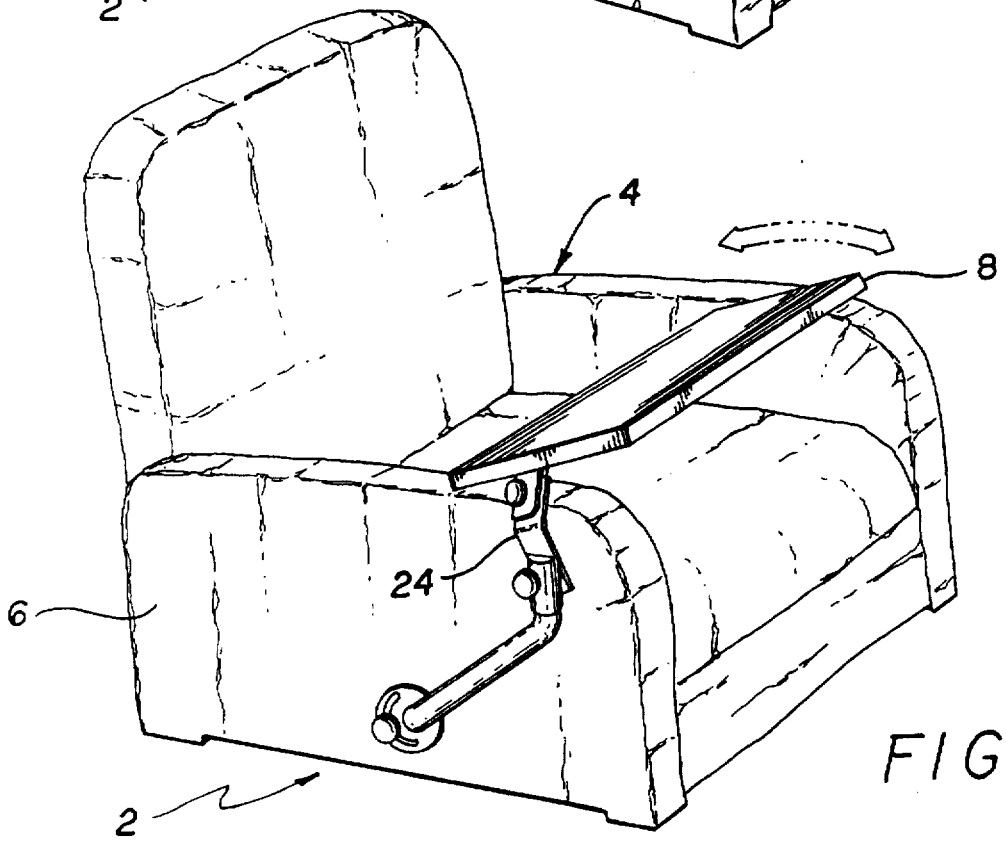
FIG. 6 is a perspective view of the invention showing another possible motion of the invention.

As seen in FIG. 6, angle support 24 may be used to rotate table 8 around axis C. The user may adjust the angular position of table 8 such that it provides the optimum position for the user's application. For example, a user may wish to type on a computer keyboard and certain angular positions may be achieved by the user to reduce stress on the user's wrists so as to avoid carpel tunnel syndrome.

FIG. 7 discloses another possible position of the present invention in use with a reclining chair. In this configuration chair 4 may be reclined, a leg rest 42 may be extended, support arm 10 may be rotated towards the rear of the chair, and angle support 24 may be adjusted so that table 8 is in an appropriate angular position for the user to perform whatever application is required. When the chair is reclined, the user will be in an especially comfortable position, yet the positioning device of the present invention will allow the user to position table 8 to perform many different kinds of functions. When table 8 is placed in a steep angular position, as is depicted in FIG. 7, a retaining device may be used to prevent objects from sliding off the table's upper surface. Such a retaining device may be comprised of mounting clips which are designed for holding specific objects, such as a keyboard, or a simple lip at the edge of table 8.

FIG. 8 shows the present invention in one of its stowed positions. In this position the table is placed close to the side of chair 4 in a substantially vertical position and the positioning system and table require very little room. The chair may then be used with a desk without interference from table 8 or positioning system 2. The present invention achieves this versatility by using axis D which is approximately 45 degrees from axis C. Angle bracket 30 is rotated around axis D such that table 8 defines an approximately vertical plane. This feature of the invention allows table 8 to be stowed in one simple motion. The user need only swing angle bracket 30 around axis D.

Figure 9:
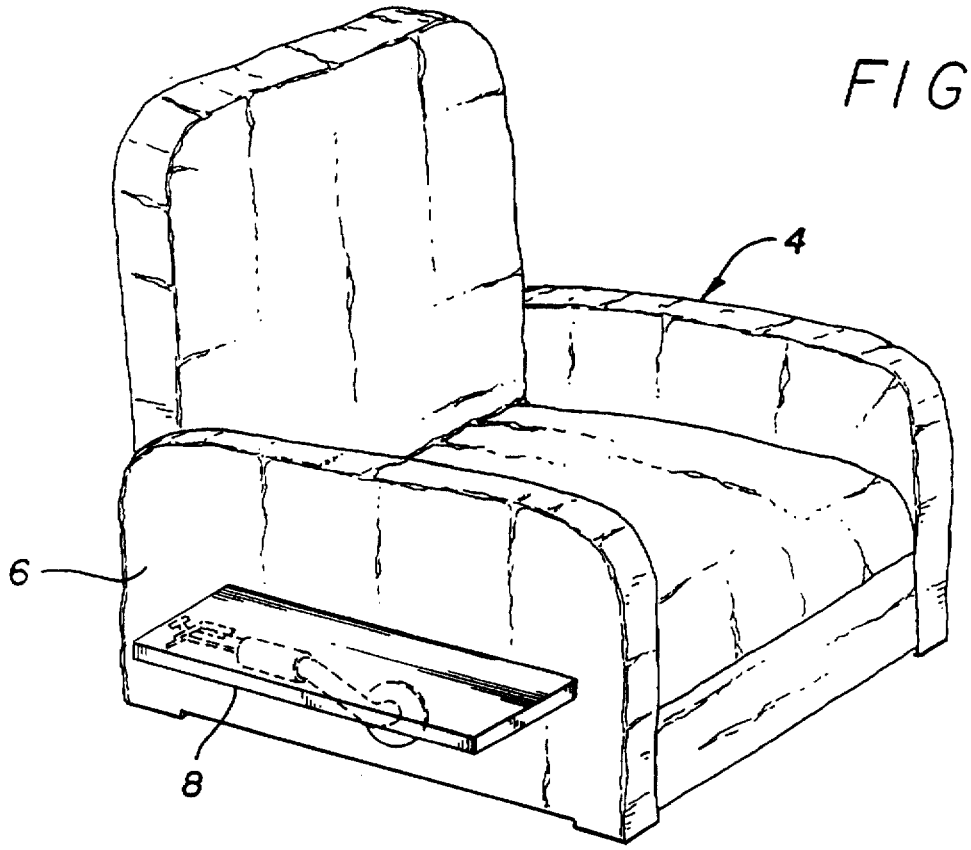
FIG. 9 is a perspective view of the present invention in its side table position.

FIG. 9 depicts yet another possible position of the present invention. This position creates a low-side table which may be used to hold objects which the user would like to have close at hand, such as a cup of coffee or a telephone. The low-side table position is achieved from the normal operating position by first rotating angle bracket 30 and attached table 8 around axis D so that positioning system 2 is in its stowed position as shown in FIG. 8. Sleeve 20 is then rotated counterclockwise around axis B so that table 8 is facing forward. Finally, support arm 10 is rotated counterclockwise around axis A until table 8 is approximately level.

Figure 10:
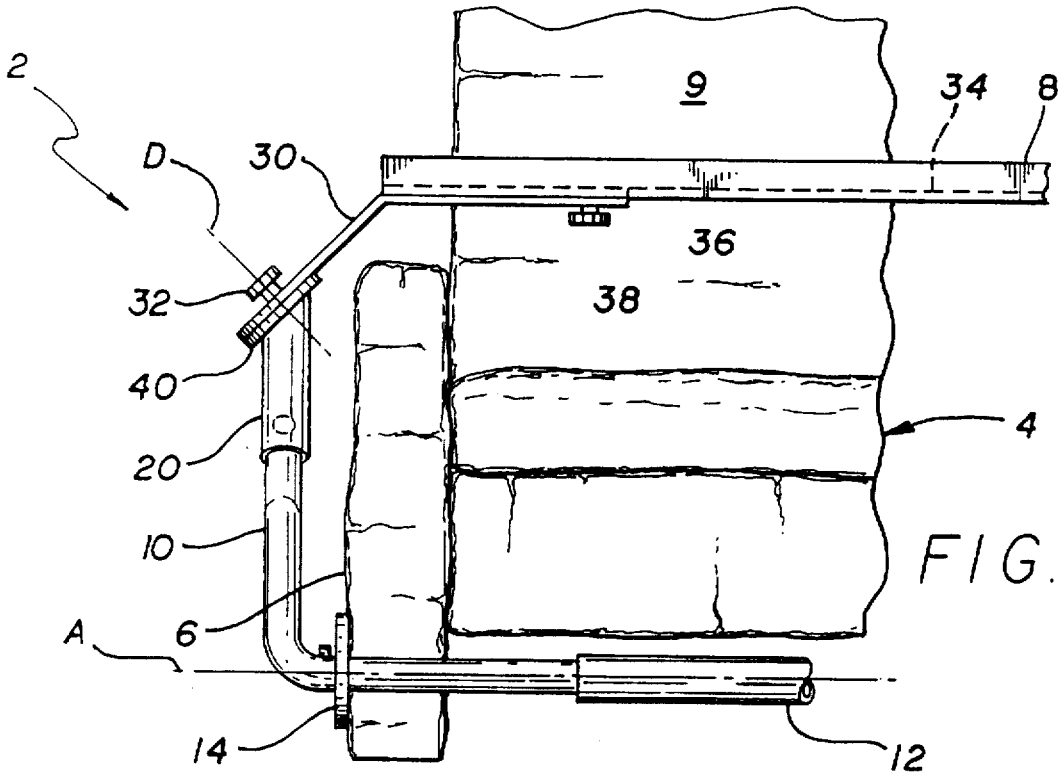
FIG. 10 is a front view of an alternative embodiment of the present invention.

FIG. 10 discloses a simplified alternative embodiment. In this embodiment, groove 16, angle support 24, and support brake 28 cannot pivot around axis C. In place of these components, a pivot plate 40 is attached to the top of sleeve 20. Pivot plate 40 defines a plane which is 45 degrees from access B. Angle bracket 30 is rotatably attached to pivot plate 40 so that it can rotate around axis D. Axis D is in the same angular orientation relative to axis B as in the embodiment described above. This embodiment is simpler to operate, less expensive to manufacture, and it still allows position system to achieve all of the orientations described above.

It may be realized from the above description that the present invention offers many advantages over the prior art. Positioning system 2 allows table 8 to be placed in numerous positions to allow the user an unprecedented degree of flexibility. The table may be used while the chair is fully reclined, the table may be quickly and easily swung away from the user, the table may be placed in a side table configuration, and the table may be stored along side of the chair.

It will be apparent that various modifications can be made to the positioning system above and shown in the drawings within the scope of the present invention. The size, configuration and arrangement of components can be different to meet specific requirements. For example, axis C may be eliminated from the positioning system, yet the table may still be placed in numerous positions which are not achieved by the prior art. Therefore, the scope of the present invention is to be limited only by the following claims:

What is claimed is:

1. A support device for supporting a table and positioning the table relative to a chair, the chair having a backrest, and a support structure, comprising:

(A) a support arm, said support arm comprising:

(a) a lower portion adapted to be rotatably attached to the support structure, wherein said support arm may rotate around an axis A, the axis A being substantially parallel to the backrest of the chair; and (b) an upper portion attached to said lower portion, wherein said upper portion defines an axis B, the axis B adapted to be substantially perpendicular to the axis A;

(B) an angle support attached to said support arm; and (C) an angle bracket adapted to support the table from said angle support, said angle bracket being rotatably attached to said angle support, wherein said angle bracket rotates around an axis D, the axis D being substantially 45 degrees from the axis B, wherein the table may be moved from a substantially horizontal position to a substantially vertical position next to the side of the chair by rotating said angle bracket around the axis D.

2. The device of claim 1 wherein said support arm comprises a sleeve for angularly positioning the table relative to the axis B, said sleeve being rotatably attached to said upper portion, said angle support being attached to said sleeve, wherein said sleeve may rotate around the axis B.

3. The device of claim 1, further comprising a sleeve slidably attached to said upper portion, wherein said sleeve may translate along the axis B, said angle support being attached to said sleeve, wherein the table may be positioned by translating said sleeve.

4. The device of claim 1 wherein said angle support is rotatably attached to said support arm, wherein said angle support rotates around an axis C, the axis C being substantially perpendicular to the axis B.

5. A support device for supporting a table from a chair, the chair having a backrest and a side, comprising:

(A) a support arm adapted to be attached to the chair, the support arm having an upper portion, said upper portion defining an axis B, the axis B adapted to be substantially parallel to the side of the chair when said support arm is attached to the chair;

(B) a sleeve rotatably attached to said upper portion of said support arm for positioning the table relative to the backrest, said sleeve being adapted to rotate around the axis B, wherein said table may be angularly positioned relative to the axis B by rotating said sleeve around the axis B;

(C) an angle support, said angle support comprising:

(a) a lower portion attached to said sleeve; and (b) an upper portion attached to said lower portion, wherein said upper portion and said lower portion form substantially a 135 degree angle; and (D) an angle bracket, said angle bracket comprising:

(a) a table portion adapted to be attached to the table; and (b) a pivot portion rotatably attached to said upper portion of said angle support, wherein said pivot portion and said table portion form a substantially 135 degree angle, wherein said angle bracket rotates around an axis D, the axis D being substantially 45 degrees from the axis B wherein the table may be moved from a substantially horizontal position to a substantially vertical position next to the side of the chair by rotating the table and said angle bracket around the axis D.

6. The support device of claim 5 wherein said support arm is adapted to be rotatably attached to said chair, wherein said support arm may rotate around an axis A, the axis A being substantially parallel to the backrest, wherein the table may be rotated away from the backrest of the chair by rotating said support arm around the axis A.

7. The support device of claim 5, wherein said angle support is rotatably attached to said sleeve, wherein said angle support rotates around an axis C, the axis C being substantially perpendicular to the axis B.

8. The support device of claim 5 wherein said sleeve is slidably attached to said upper portion, wherein said sleeve may be translated along the axis B.

9. A chair comprising:

(A) a support structure for providing structural support to the chair;

(B) a seat attached to said support structure for supporting a user while seated;

(C) a backrest attached to said support structure for supporting the user's back;

(D) a table for providing a working surface and for holding objects;

(E) a support arm rotatably attached to said support structure for supporting said table, said table being attached to said support arm, wherein said support arm rotates an axis A, the axis A being substantially parallel to said backrest, wherein said table may be positioned relative to said backrest by rotating said support arm around the axis A, said support arm comprising:

(a) an angle support for supporting said table, said angle support comprising:

(1) a lower portion rotatably attached to said support arm wherein said support angle rotates around an axis C, the axis C being substantially parallel to the axis A, wherein said table may be positioned by rotating said angle bracket around the axis C; and (2) an upper portion attached to said lower portion, wherein said upper portion and said lower portion form a substantially 135 degree angle; and (b) an angle bracket attached to said table for supporting said table, said angle bracket comprising:

(1) a table portion attached to said table; and (2) a pivot portion rotatably attached to said upper portion of said angle support, wherein said upper portion and said lower portion form a substantially 135 degree angle, wherein said support bracket rotates around an axis D, the axis D being substantially 45 degrees from the axis C.

10. The chair of claim 7 further comprising reclining means for reclining said backrest, wherein said table may be positioned to allow a user to use said table when said backrest is in a reclined positioned by rotating said support arm around the axis A.

11. The chair of claim 9 wherein said support arm comprises a sleeve rotatably attached to said support arm, said angle support being attached to said sleeve, wherein said sleeve rotates around an axis B, the axis B being substantially perpendicular to the axis A.

12. The chair of claim 9 wherein said table comprises a groove and said angle bracket comprises a tongue, said groove being adapted to slidably receive said tongue, wherein said table is slidably attached to said angle bracket and said table may be translated along an axis of said table.

13. A support device for supporting a table and for positioning the table relative to a chair, the chair having a backrest, a side, and a support structure, comprising:

(A) a support arm, said support arm comprising:

(a) a lower portion adapted to be rotatably attached to the support structure, wherein said support arm may rotate around an axis A, axis A being substantially parallel to the backrest of the chair, wherein the table may be positioned relative to the backrest of the chair by rotating said support arm around axis A; and (b) an upper portion attached to said lower portion, said upper portion defining an axis B, the axis B adapted to be substantially perpendicular to the axis A;

(B) a sleeve for angularly positioning the table relative to the axis B, said sleeve being rotatably attached to said upper portion, wherein said sleeve may rotate around the axis B;

(C) a angle support attached to said sleeve; and (D) an angle bracket rotatably attached to said angle support for supporting the table wherein said angle bracket rotates around an axis D, the axis D being substantially 45 degrees from the axis B; wherein the table may be moved from a substantially horizontal position to a substantially vertical position next to the side of the chair by rotating said angle support around the axis D.

* * * * *